United States Patent [19]

Johnson

[11] 3,956,872

[45] *May 18, 1976

[54] CARTON BRANDING APPARATUS

[75] Inventor: John A. Johnson, New Richmond, Ohio

[73] Assignee: Cedar Sales Company, Cincinnati, Ohio

[ * ] Notice: The portion of the term of this patent subsequent to Mar. 25, 1992, has been disclaimed.

[22] Filed: Dec. 7, 1973

[21] Appl. No.: 422,886

Related U.S. Application Data

[63] Continuation-in-part of Ser. No. 405,909, Oct. 12, 1973, Pat. No. 3,872,646.

[52] U.S. Cl. ..... 53/131; 93/36 R

[51] Int. Cl.[2] ..... B65B 61/02

[58] Field of Search ..... 53/131, 373, 375; 93/44.1 R, 44.1 GT, 36 R; 101/9, 11, 27, 31, 381; 219/216

[56] References Cited

UNITED STATES PATENTS

| | | | |
|---|---|---|---|
| 350,863 | 10/1886 | Bryant | 101/31 |
| 1,131,866 | 3/1915 | Putnam | 101/381 X |
| 1,369,934 | 3/1921 | Onstad | 101/11 X |
| 2,369,172 | 2/1945 | Nordquist | 101/11 |
| 2,558,354 | 6/1951 | Gottscho | 101/31 X |
| 2,597,634 | 5/1952 | Grevich | 53/131 |
| 2,751,965 | 6/1956 | Miller | 53/373 X |
| 2,887,835 | 5/1959 | Stubblefield | 101/11 X |
| 3,187,646 | 6/1965 | Monroe | 93/44.1 R |
| 3,405,505 | 10/1968 | Mistarz | 93/441 GT X |
| 3,619,979 | 11/1971 | Martensson | 53/375 X |
| 3,820,303 | 6/1974 | Martensson | 53/373 X |
| 3,872,646 | 3/1975 | Johnson | 53/131 |

*Primary Examiner*—Travis S. McGehee
*Assistant Examiner*—John Sipos
*Attorney, Agent, or Firm*—Wood, Herron & Evans

[57] ABSTRACT

Apparatus for branding dater or other indicia into predetermined areas of liquid food products containers, such as the top ribs of milk cartons, includes an anvil member adapted to be attached to a movable rib compression jaw of a carton filling and sealing apparatus, and a heated dater block mounting date-applying structure, the block being mounted on the apparatus such that the date-applying structure is aligned with the anvil. The anvil and dater block comprise a dating station which is adjacent the compression station of the apparatus and so close to the compression station that the conveyor of the apparatus positively indexes cartons toward and away from the dating station. When the movable compression jaw moves toward a carton rib to compress it against the other jaw, the dater anvil is thereby moved toward the rib of a downstream carton to press it against the heated date-applying structure and a date is branded into the rib. Thereafter, the carton conveyor engages and moves a compressed carton toward the dating station and engages and moves a dated carton away from the dating station. The dater requires no driving mechanism nor other dater element actuating devices of its own, but rather derives its movement from the movement of carton treating or closure-forming apparatus of the filling and sealing apparatus with which the dater is associated. Further, cartons are positively indexed to and away from the dater and double dating single cartons is eliminated without requiring additional mechanism in the dater unit.

13 Claims, 4 Drawing Figures

CARTON BRANDING APPARATUS

This application is a continuation-in-part of my copending patent application, U.S. Ser. No. 405,909, filed Oct. 12, 1973, now U.S. Pat. No. 3,872,646, and entitled "CARTON DATING APPARATUS."

This invention relates to container marking apparatus and more particularly to apparatus for applying date indicia, by branding, to packaging containers for perishable foods such as milk.

In the milk packaging industry, it is becoming increasingly mandatory in many localities to apply visible date indicia to milk containers in order to indicate the date on which the milk was packaged and thereby aid the consumer in choosing fresh milk and the retailer in eliminating old and perhaps soured milk from his shelves. Since milk is normally packaged by a large number of independent dairies, it is common for each dairy to apply the packaging date to the milk cartons at the time the milk is packaged by the dairy.

With respect to the currently typical thermoplastic coated paperboard milk cartons, the actual carton dating has been accomplished in primarily three different modes: inking, stamping or embossing, and branding. Where the inking technique, whether wet or dry, is used, the dater must always be provided with a supply of ink fluid, inked tapes or the like and thus requires fairly frequent attention during operation. The stamping or embossing technique requires no such consumable supply, but the stamped or embossed date is not highly visible and does not meet the visibility regulations of some areas. Unlike these, the branding mode requires no ink or ink tape supply and is highly visible as contrasted with the embossing technique due to the partial burning of the thermoplastic material and of the paperboard. The branding mode would thus seem to be at least technically preferred and is the preferred dating mode contemplated by the present invention, although the invention could be adapted for use within the other modes as well.

There are currently a number of different types of carton filling and sealing apparatus commercially available for packaging milk in such cartons; some include a dating capability and others, as originally manufactured, do not. Where the filling and sealing apparatus of a particular dairy does not have the dating capability, it is necessary for a dairy to purchase auxiliary machinery to perform a desired dating function.

Whether a dairy's filling and sealing apparatus incorporates a dater, or whether a dairy utilizes an auxiliary dater in association with a separately made filler and sealer, there are a number of problems which exist with either type of dating unit. Whether inking, embossing, or branding, current daters generally include engagement of the carton by a reciprocating member which applies the date to the carton. These daters thus normally require a plurality of moving parts and a driving mechanism for providing the required movement toward and away from cartons to be dated. In many cases, these mechanisms are timed with various movements of the associated filling and sealing apparatus and some form of timing mechanism is required. Even further, some daters must have their own carton handling apparatus for properly indexing the cartons to and away from the dating station.

Thus, in both cases, the present commercial daters are normally complex units having a multiplicity of moving parts required to make them operate in a specified timed relationship with the filler and sealer with which they are associated. They are, therefore, expensive in themselves or add substantially to the cost of filling and sealing apparatus with which they are provided. Additionally, the units require supervision and maintenance, and downtime for repair results in concurrent downtime for the associated filler and sealer.

When a particular locality adopts a milk carton dating regulation, affected dairies having filling and sealing apparatus with no dating capability face the problem of purchasing daters to conform to the regulations. In addition, it is desirable, from a practical marketing standpoint, for the manufacturer of new filling and sealing apparatus to provide a dating capability to such apparatus as will be sold in areas having dating regulations. In both instances, it is higly desirable to keep initial cost down and to eliminate or reduce other cost factors such as maintenance.

It has thus been a primary objective of the invention to provide improved dating apparatus for applying dates to milk containers.

A further objective of the invention has been to provide improved apparatus for branding dates into thermoplastic coated paperboard milk cartons.

A further objective of the invention has been to provide an economical dater made from a minimum number of moving parts and which can be very easily adapted and applied to existing carton filling and sealing apparatus.

A related and more specific, yet highly important, objective of the invention has been to provide a carton dater for use with existing carton filling and sealing apparatus, the dater having a minimum number of moving parts with no independent driving mechanism of its own, but rather deriving its operating movements from the motion of other moving elements at spaced stations within the filling and sealing apparatus.

One particular filling and sealing apparatus now in use is that manufactured by the Excello Corporation and marketed under its model designation "Q-P." This apparatus is generally operable to fill and seal quart capacity milk containers of the type made from thermoplastic coated paperboard having a gable top end closure terminating in a rib comprising a plurality of adjacent parallel panels. As a part of the carton sealing operation of this device, upper panels of the carton are heated and therafter pressed together, at a compression station, between stationary and movable compression jaws to form the closure rib mentioned above. One construction of such jaws is shown in U.S. Pat. No. 3,002,328.

A conveyor is utilized in the apparatus to move cartons from one station to another and the conveyor normally comprises a chain disposed in two parallel longitudinal runs between appropriate sprockets. The chain has protruding lugs and one chain run is parallel to the desired carton path through the filling and sealing apparatus so that the projecting lugs engage cartons and convey them through the apparatus, in spaced relationship, toward the discharge end of the conveyor and of the apparatus. In this connection, the cartons are discharged or are disengaged by the lugs near one sprocket, the lugs withdrawing from the cartons as the lugs and chain follow the circumference of the sprocket toward the return chain run.

The sprocket at the discharge end of the conveyor is normally located in proximity to the compression station so that cartons are positively engaged by the conveyor lugs and are conveyed away from the compression station before the lugs withdraw from the sprocket. When the lugs thereafter withdraw from the sprocket, the cartons are normally located on a deadplate or skid-plate and they remain motionless until subsequent cartons are conveyed out of the compression station. As positively driven cartons are conveyed out of the compression station, they engage downstream cartons and push them along, at the discharge end of the apparatus, through subsequent treating stations, such as a water sprinkler which cools the heated carton top. Thus, once the conveyor disengages from the compressed cartons, further carton movement depends on pressure from succeeding cartons discharging from the compression station.

In the past, it has been the practice to apply a date to the top rib of these cartons as they are moved along by the pressure of succeeding cartons subsequent to discharge from compression stations. A typical dater has included two members, movable toward each other and toward opposite sides of a carton rib therebetween, to apply a date to the rib. These members are usually driven by a driving mechanism of the dater which is controlled and timed with respect to the discharge rate of cartons from the compression station.

Such a dater has a number of disadvantages. For example, the dater itself is rather complex and relatively expensive due to the requirement of a driving mechanism for the dater jaws which must be moved toward and away from the carton rib.

A further disadvantage exists since pressure from succeeding cartons is required to move or index each dated carton out of the dater station. It can be appreciated that the dater is timed with the filling and sealing apparatus to normally apply one date for each carton discharged from the compression station. In this connection, should there be a void space in the carton conveyor, for some reason occurring upstream in the filling and sealing apparatus, the line of cartons depending for movement on carton discharge from the compression station would not be moved or indexed. Thus, the previously dated carton would still be in the dater station and would receive a second date. Where the dater is adapted to brand dates into the carton ribs, this second brand could jeopardize or ruin the seal of the top rib, requiring the carton to be rejected and resulting in waste. It has thus been necessary to provide such dater with still further mechanism for preventing this double dating and this adds still further to the cost and complexity of the dater. Of course, such daters require frequent maintenance and service, holding up the milk packaging output of the filling and sealing apparatus with which the dater is associated.

It has thus been a further objective of the invention to provide a carton dater particularly adapted for use with milk carton filling and sealing apparatus of the type manufactured by the Excello Corporation under its Model No. Q-P, and other models similar thereto.

A related objective of the invention has been to provide a carton dater, for the carton filling and sealing apparatus, wherein the dater derives its operational motion from the normal reciprocation of the carton top rib compression jaws of the apparatus.

A further objective of the invention has been to provide a carton dater for dating cartons while the cartons are still under positive control of the conveyor of the filling and sealing apparatus with which the dater is associated.

A further objective of the invention has been to provide a carton dater for milk carton filling and sealing apparatus, the dater being disposed to apply a branded date to a carton panel after the cartons have been filled with milk and sealed.

In a preferred embodiment, the present invention includes an anvil member adapted to be attached to a movable rib compression jaw of a carton filling and sealing apparatus, and a heated dater block mounting date-applying means, the block being mounted on the apparatus such that the date-applying means are aligned with the anvil. The anvil and dater block comprise a dating station which is adjacent the compression station of the apparatus and so close to the compression station that the conveyor of the apparatus positively indexes cartons toward and away from the dating station.

When the movable compression jaw moves toward a carton rib to compress it against the other jaw, the dater anvil is thereby moved toward the rib of a downstream carton to press it against the heated date-applying means and a date is branded into the rib. Thereafter, the carton conveyor engages and moves a compressed carton toward the dating station and engages and moves a dated carton away from the dating station.

It can readily be appreciated that the preferred embodiment provides a dater requiring no driving mechanism nor other dater element actuating devices of its own, but rather derives its movement from the movement of carton treating or closure-forming apparatus of the filling and sealing apparatus with which the dater is associated. Further, cartons are positively indexed to and away from the dater and double dating single cartons is eliminated without requiring additional mechanism in the dater unit.

These and other objects and advantages of the invention will become readily apparent from the following detailed description of a preferred embodiment and from the drawings in which.

FILLING AND SEALING APPARATUS

Figure 1:
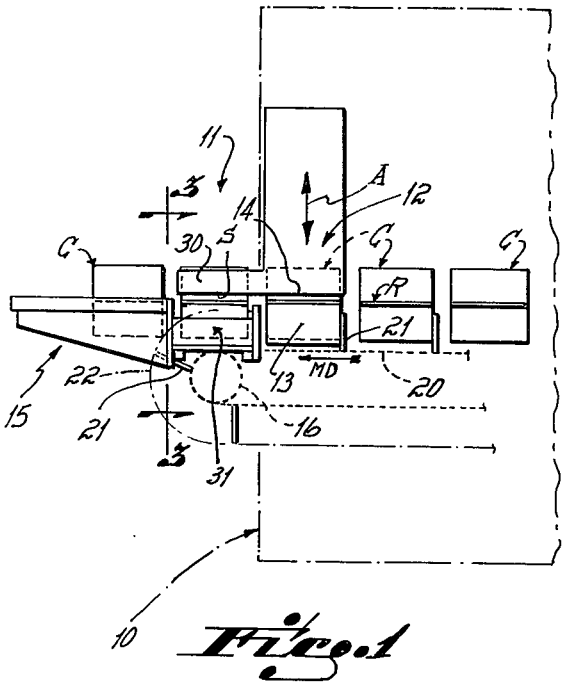
FIG. 1 is a top plan view showing the brander provided by the invention in operable relationship to a milk filling and sealing apparatus.

Now referring specifically to the drawings and particularly to FIG. 1 thereof, an existing milk carton filling and sealing apparatus is shown at 10 and a dater apparatus provided by the present invention is shown generally at 11. While the principles of the present invention can be usefully applied to different filling and sealing apparatus, the particular apparatus shown diagrammatically at 10 is a milk carton filling and sealing apparatus of the type marketed by the Excello Corporation under its Model No. Q-P. This particular apparatus is operable to fill and seal quart capacity thermoplastic coated paperboard milk cartons at an approximate rate of 75 cartons per minute. The various carton forming filling and sealing operations carried on throughout the filling and sealing apparatus are shown in more particular detail in U.S. Pat. Nos. 3,002,328 and 3,187,646. Other filling and sealing apparatus is marketed by this same company and is operable to fill milk cartons of different capacities and at different rates. It will be hereinafter appreciated that the present invention can easily be adapted to the various models or to other carton filling and sealing apparatus which requires carton dating. In its preferred embodiment, however, the invention will only be described with regard to the Excello Q-P carton filling and sealing apparatus.

Milk cartons of the type generally filled and sealed on the filling and sealing apparatus are typically manufactured from a thermoplastic coated paperboard laminate. A polyethylene coating is one form of thermoplastic material which is suitable. In erected form the cartons comprise a rectangular tube having a bottom closure and a gable top end closure terminating in a rib comprising a plurality of adjacent parallel panels. Cartons C are diagrammatically shown throughout the drawings and each carton C is provided with a terminal rib R. As particularly shown in FIG. 3 of the drawings, rib R extends vertically upwardly from the gable top end closure on the carton C and it is to this rib R that the invention is operable to apply a date indicating when the carton was filled and sealed.

The filling and sealing apparatus with which the dater 11 is utilized includes at least one compression station 12 comprising a generally stationary jaw 13 and a movable jaw 14. After the cartons have been formed and filled on the filling and sealing apparatus, the panels of the carton are heated and are thereafter compressed together in order to form the upstanding rib R. The panels are coated with a thermoplastic material and, upon heating and compression while the thermoplastic material cools, the compressed panels are thereby adhered together to form a liquid tight seal at the top of the carton. The particular details of the compression jaws for pressing the panels together to form the rib are shown in FIGS. 31 and 32 of both U.S. Pat. Nos. 3,002,328 and 3,187,646. It is disclosed in those patents that the milk container is engaged by the compression jaws at two different positions and it should be understood with regard to the description of the preferred embodiment of the invention that the stationary jaw 13 and the movable jaw 14 comprise the second one of these different positions.

Prior to the modification of the filling and sealing apparatus in accordance with the invention, the apparatus included a water sprinkler system 15 connected to the apparatus immediately following the last compression station. The sprinkler was operable to spray the heated and sealed carton tops in order to cool them. After modification, and as shown in FIG. 1, the sprinkler system 15 has been displaced rearwardly from its normal position with respect to the filling and sealing apparatus.

In order to convey cartons throughout the filling and sealing apparatus a carton engaging lug and chain type conveyor has one conveyor run disposed adjacent the desired path of the cartons throughout the apparatus. This conveyor is partially shown in a diagrammatic form in FIG. 1 and includes a chain 20 bearing outwardly extending lugs 21. The chain 20 is disposed at the discharge end of the filling and sealing apparatus about a turnaround sprocket 16 so that the chain has one run disposed along a predetermined carton path in the apparatus and a return run.

As shown in FIG. 1, as the chain is drawn around the sprocket 16 the lugs 21 are drawn through the curved path indicated by the phantom line 22. It can be appreciated from FIG. 1 that the lugs 21 engage cartons at the compression station formed by the jaws 13 and 14 and are operable upon movement of the chain 20 to engage and convey cartons away from the compression station 12. Thereafter, as the chain is drawn around the sprocket 16, the lugs disengage from the cartons and move toward the return run of the conveyor. At this point, the cartons are supported by a dead-plate or skid-plate (not shown) and are no longer under positive conveyor control of the filling and sealing apparatus. For continued carton movement, such as through the sprinkling system, the apparatus relies on the pressure from succeeding cartons being discharged from the compression station 12.

DATING APPARATUS

Figure 2:
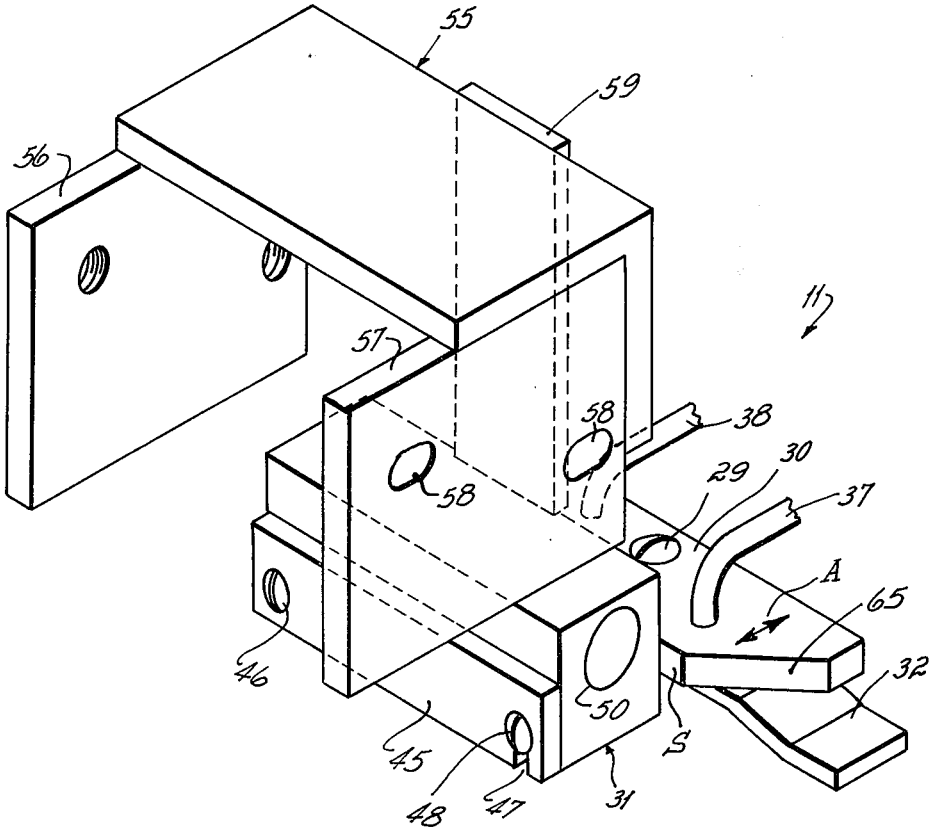
FIG. 2 is a perspective view of a brander provided by the invention.
Figure 3:
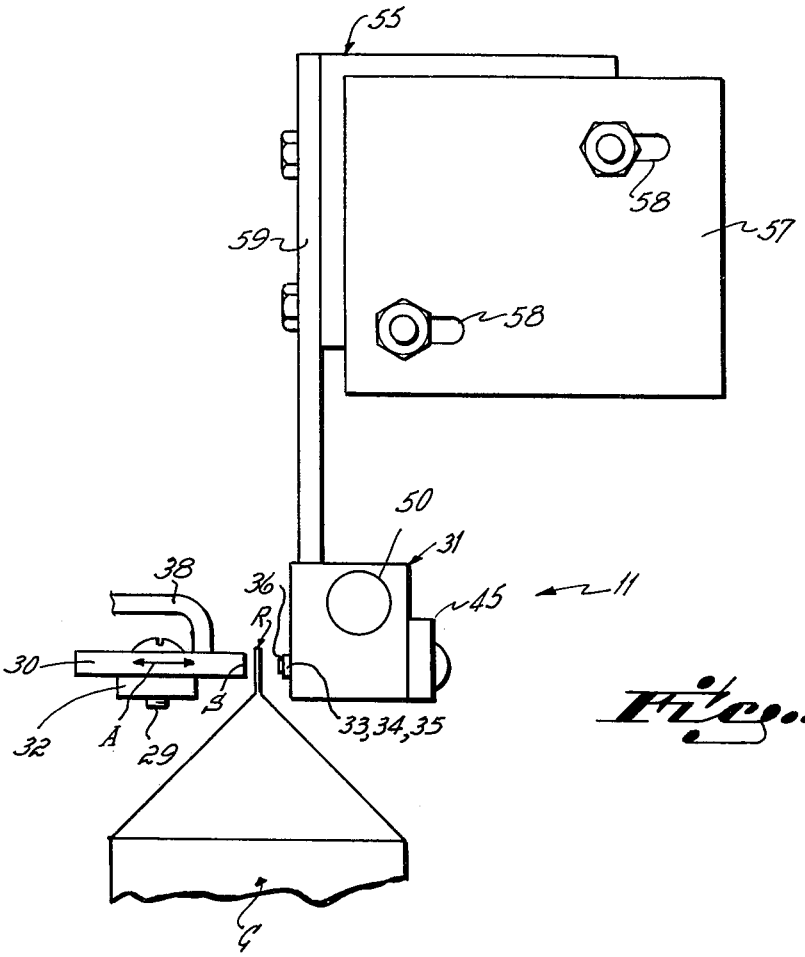
FIG. 3 is a partial view of the invention taken along the lines 3—3 of FIG. 1.
Figure 4:
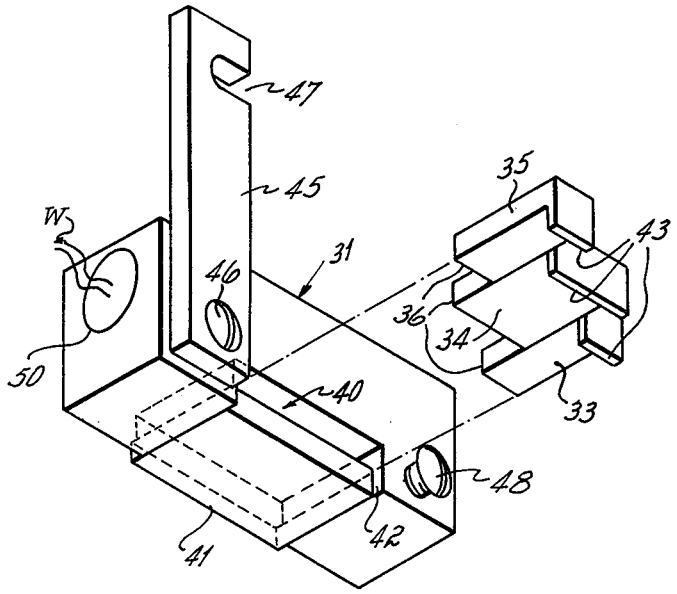
FIG. 4 is a perspective view of the dater block of the invention.

In order to apply a date to the upstanding rib R of cartons after the cartons have been filled and sealed and subsequent to their passage through the compression station 12, a dater unit 11 is disposed closely adjacent the station. FIG. 1 shows the general location of the dater unit 11 but its details are best seen in FIGS. 2–4. The dater apparatus includes an anvil member 30 and a dater block 31 which are movable with respect to each other in order to apply a date to the compressed carton rib R therebetween. As will be described, the dater apparatus 11 includes no driving mechanism of its own but rather derives its movements for applying dates from the movable compression jaw of the filling and sealing apparatus.

To this end, the anvil 30 is mounted on a connecting bar 32 via bolts 29. The connecting bar 32 is welded or otherwise attached to the movable compression jaw 14 of the filling and sealing apparatus. In this manner, the anvil is thereby connected to the filling and sealing apparatus so as to move in the reciprocal directions indicated by the arrow A in FIGS. 1 and 2. Thus the anvil is moved directly in the directions of arrow A as the movable compression jaw 14 is moved toward the stationary jaw 13 in order to compress the carton rib therebetween. Of course, the position of movable jaw 14 may be reversed with that of stationary jaw 13 and the anvil and dater block positions could also be reversed.

The anvil 30 includes an internal bore (not shown) and inlet anc outlet lines 37 and 38 at opposite ends of the bore. When these lines are connected to a source of circulating coolant, such as water, the anvil's temperature is reduced and the thermoplastic on the carton rib does not tend to stick to the anvil as it would if the anvil was relatively warmer in temperature. This cooling is an advantageous feature due particularly to the environment, i.e., the close proximity of the anvil to the heated dater block as will be described and to the compression jaws and carton top heating apparatus.

The dater block 31 is mounted in a position spaced from but aligned with the anvil 30 and the dater block includes suitable date stamping indicia applying means such as dies 33–35, as shown in FIG. 4. Each of the dies 33–35 has a forward end 36 which bears raised numerals (not shown) indicating a selected predetermined date. The dater block and anvil are mounted so that these numerals are aligned with anvil surfaces. The forward ends of the dies extend outwardly of the dater block 31, shown in FIG. 3, so that the ends are operable to engage a rib R as the anvil 30 moves to compress the rib R against the dies.

A transverse slot 40 is milled into the dater block 31. The slot 40 is covered by a plate 41 which also extends outwardly of the dater block 31 but terminates short of the forward end 36 of the stamping dies. The rear end of the plate 41 is thus not flush with the rear side of the dater block 31 and leaves a slight relieved portion 42 (FIGS. 3 and 4). The date stamping dies 33–35 are provided with transverse lugs 43 and when the dies are inserted into the slot 40, the lugs engage the rear portion of the plate 41, in the relieved area 42 of the dater block. This prevents the date stamping dies from moving forwardly out of the dater block. A gate 45 is pivoted about bolt 46 and includes a notch 47 for cooperation with a latching bolt 48. The gate is pivoted in order to uncover the slot 40 and thereby facilitate changing of the date stamping dies 33–35.

The dater block 31 also includes an elongated through bore 50. A cartridge type heater (not shown) is inserted into the through bore 50 and provides a means by which the complete dater block 31 and the date stamping dies 33–35 are heated. Any suitable heater could be utilized, however, in the preferred embodiment a cartridge heater manufactured by the Fast Heat Manufacturing Company under its Catalog No. H5-24 and rated at 350 watts-120 volts has been found to be suitable. This heater is generally cylindrical in appearance and includes wires W for connection of the heater to a source of electricity. When the heater is energized, it elevates the temperature of the dater block and of the date stamping dies to a suitable temperature whereby the raised symbols of the dies are sufficient to brand the upstanding rib R of carton C when the rib is pressed from the opposite side against the dies by the anvil 30.

In order to control the darkness of the brand, the heater is connected to a powerstat unit which in turn is variable to control the electrical output to the heater and therefore the heat produced by heater. One powerstat which has been found to be suitable is that sold by Superior Electrical Company as its Type 21. The powerstat and heater are connected together and the powerstat is connected to a source of electrical energy in any suitable manner.

Thus, when the raised numerals are passed against the rib R of the carton C, they not only emboss the rib but burn the thermoplastic and paperboard and thereby apply dates by branding the carton with the particular date selected. It has been found that this brand provides a highly visible and indelible marking on the carton rib.

Since the forward end of the plate 41 extends outwardly of the dater block and against the outwardly extending forward portions 36 of the date stamping dies, the plate serves to thereby maintain the forward ends of the dies at an elevated temperature and thereby serves to reduce the total heater output required during operation of the dater. Of course, the plate 41 could be constructed to be flush with the dater block if that were desired or if it were in some way interferring with the carton structure when the top rib R was branded.

The dater block 31 is mounted to the filling and sealing apparatus 10 in a generally stationary condition. Since the dater block is mounted in a position closely adjacent the compression station 12, it is necessary to displace the sprinkler system 15 and it has thus been found advantageous to provide means for mounting the dater block in its proper position and as well for mounting the sprinkler in an operative position displaced from its original location. To this end, an elongated mounting bracket 55 is provided with spaced end flanges 56 and 57. The flange 57 includes elongated mounting holes 58, spaced to match the sprinkler mounting holes on the apparatus 10. An elongated member 59 is bolted to the elongated bracket 55 and extends downwardly therefrom, the dater block 31 being appropriately connected to the lower end of the element 59. In order to adjust the desired spacing between the anvil 30 and the dater block 31, the bracket 55 and the end flange 57 may be moved, within the range provided by the elongated mounting holes 58, thereby to adjust the position of the dater block 31 and the position of the forward ends 36 of the date stamping dies. It will be appreciated that the spaced end flanges 56 and 57 are spaced apart a distance approximately equal to the length of the dater block 31. The sprinkler system 15 is bolted onto the end flange 56 and is thus maintained adjacent the path of the cartons C in order to sprinkle them with a coolant after the cartons have been branded.

As shown in FIG. 1, the anvil 30 and the dater block 31 are positioned with respect to the conveyor chain and lugs 21 so that the lugs positively engage cartons at the dating station and are operable, upon movement of the chain, to positively eject cartons from the dating station, the lugs just disengaging from the cartons as the cartons are moved away from the anvil and heated dater block. Thus it can be appreciated, that the cartons at the dating station are still under the positive control of the conveyor of the filling and sealing apparatus 10, and it is unnecessary to provide apparatus for retracting either the anvil or the dater block should there be a void in the line of cartons.

Of course it can be appreciated that the dating station formed by the anvil 30 and the dater block 31 is spaced from the compression station formed by the jaws 13 and 14 a distance equal to that of the carton spacing on the conveyor (on some multiple thereof within positive conveyor engagement). Thus, as the conveyor moves a carton into the compression station 12, a compressed carton is moved into the dating station. When the movable jaw 14 is moved by the filling and sealing apparatus to compress a carton rib R between itself and the stationary jaw 13, the anvil 30, via the connecting bar 32, is moved toward a carton rib R of a downstream carton to press the rib against the dater block and thereby cause the date to be branded into the rib. When the movable jaw 14 is withdrawn from a compressed rib, the anvil is also withdrawn from the downstream carton and the conveyor is operable to positively move the branded carton out of the dating station and to move a succeeding compressed carton into the dating station for dating. Once the cartons have been ejected from the dating station they can be moved through the sprinkling system via pressure by succeeding cartons being ejected from the dating station, or a separate carton conveyor can be provided at this end of the apparatus for moving cartons through the sprinkler system to a discharge point.

To facilitate transfer of cartons from the compression station to the dating station, anvil surface S has a leading portion 65 tapered as shown in FIGS. 1 and 2. This surface aids in guiding carton ribs R into position between the anvil surface S and the dies 33–35.

It can thus be appreciated that the invention provides very simple and economical apparatus for the dating of cartons in existing milk carton filling and sealing apparatus. The dater provided by the invention can be very easily applied to either existing apparatus or to such apparatus during original manufacture. The operational movements of the dater are derived from the normal motion of elements associated with a carton treating station (such as a compression station) of the existing apparatus so that the dater provided by the invention does not require an individual driving mechanism. As a result of the spacing of the dater unit with respect to the station from which the motion of the dater unit is derived, no elaborate timing mechanism is required for the dater. Very little maintenance is required in order to keep the dater of the present invention in operation as it has a minimum number of moving parts. Maintenance problems and costs are thereby significantly reduced as compared to those units which require their own driving or timing mechanisms. In addition, the date stamping dies which bear the date indicating numerals are very easily changeable and the day-to-day changeover from one date to the next is quickly accomplished.

The dater of the preferred embodiment has an additional advantageous feature in that when mounted as described, it brands dates on the top ribs of cartons after the cartons have been filled and sealed. It thus does not require the engagement of any internal portion of the carton by any supporting anvil or other mechanism which may contaminate the carton.

While a preferred embodiment of the invention has been described, it will be appreciated that other modifications and alterations will become readily apparent to those of ordinary skill in the art without departing from the scope of the invention and the applicant intends to be bound only by the appended claims.

I claim:

1. In carton filling and sealing apparatus of the type having means for filling and sealing thermoplastic coated cartons having a top closure terminating in a rib including a plurality of parallel adjacent carton panels, said means for sealing cartons including a compression station having an upstream set of sealer jaws and a downstream set of sealer jaws, each set comprising two sealer jaws, one of which is movable toward and away from the other for pressing said panels together after said panels and the thermoplastic thereon have been heated, in order to allow said thermoplastic to set and seal said panels together, dating apparatus spaced from said two sets of sealer jaws for applying date indicia to the ribs of cartons downstream from said compression station, said dating apparatus comprising:

an anvil means connected to the movable jaw of said downstream set of jaws, and dater block means spaced from and aligned with said anvil means, said dater block means including protruding date indicia applying means aligned with said anvil means for applying dates to a carton rib between said anvil means and said dater block means when the movable jaw to which said anvil means is connected is moved toward the other jaw of said downstream set to compress another upstream carton rib, thereby moving the anvil toward said dater block and said date indicia means said dater block means including means for heating said date indicia applying means so that date indicia is branded into the carton rib.

2. Dating apparatus as in claim 1 wherein said date indicia applying means comprises protruding date stamping dies and wherein said dater block includes an electrical heater for heating said protruding date stamping dies so as to brand dates into said carton rib.

3. Apparatus as in claim 2 wherein said filling and sealing apparatus includes a conveyor for moving said cartons successively between said compression jaws and then between said anvil means and said dater block means, said anvil means and said dater block means comprising a dating station spaced downstream of said compression station so that said date indicia is applied to said carton rib subsequent to the filling and sealing of said carton.

4. Apparatus as in claim 3 wherein said dating station is located adjacent said compression station so that a first carton is dated by said anvil means and said dater block means while as immediately succeeding carton is compressed at said compression station.

5. Apparatus as in claim 4 wherein said conveyor positively engages and moves cartons out of said dating station.

6. Apparatus as in claim 5 wherein said filling and sealing apparatus includes a water sprinkler means for spraying water onto said cartons at a station subsequent to said compression station, said dater block means being mounted between said compression station and said sprinkler means.

7. Apparatus as in claim 6 including an elongated mounted bracket for mounting said dater block means, said bracket having end flanges connected respectively to said filling and sealing apparatus and to said sprinkler means.

8. Apparatus as in claim 1 wherein said cartons comprise thermoplastic coated paperboard.

9. Apparatus as in claim 2 wherein said dater block means includes a transverse slot extending therethrough, said dies being mountable within said slot so as to protrude from a forward end thereof toward said anvil.

10. Apparatus as in claim 9 further including a gate means for closing a rear end of said slot to hold said dies therein.

11. Apparatus as in claim 10 wherein said dies have protruding lugs engaging a portion of said dater block means for restricting die movement with respect thereto.

12. Apparatus as in claim 1 wherein said anvil includes at least one internal passageway having an inlet and an outlet, said inlet being connected to a source of coolant for cooling said anvil.

13. Apparatus as in claim 1 wherein said dater block means is rigidly mounted to said filling and sealing apparatus but is adjustable with respect to said anvil.

* * * * *

UNITED STATES PATENT AND TRADEMARK OFFICE

CERTIFICATE OF CORRECTION

PATENT NO. : 3,956,872

DATED : May 18, 1976

INVENTOR(S) : John A. Johnson

It is certified that error appears in the above-identified patent and that said Letters Patent are hereby corrected as shown below:

Column 6, line 47, "anc" should be --and--.

Column 7, line 37, insert --the-- between "by" and "heater".

Column 7, line 43, "passed" should be --pressed--.

Column 10, line 23, Claim 4, "as" should be --an--.

Signed and Sealed this

Seventh Day of June 1977

[SEAL]

*Attest:*

RUTH C. MASON
*Attesting Officer*

C. MARSHALL DANN
*Commissioner of Patents and Trademarks*